US006049274A

United States Patent [19]

Stachurski

[11] Patent Number: 6,049,274

[45] Date of Patent: Apr. 11, 2000

[54] PORTABLE SECURITY SYSTEM

[76] Inventor: Andrzej Stachurski, Unit 2, Vickery Villas, 8/2 Mansfield Street, Bunbury, Western Australia, Australia, 6230

[21] Appl. No.: 09/144,451

[22] Filed: Sep. 1, 1998

[30] Foreign Application Priority Data

Sep. 5, 1997 [AU] Australia ..... PO-8975

[51] Int. Cl.[7] ..... G08B 13/00

[52] U.S. Cl. ..... 340/541; 340/567

[58] Field of Search ..... 340/539, 541, 340/506, 507, 691.1, 693.1, 693.2, 693.3, 693.5, 567

[56] References Cited

U.S. PATENT DOCUMENTS

| | | | |
|---|---|---|---|
| 4,755,816 | 7/1988 | DeLuca | 340/636 |
| 4,992,701 | 2/1991 | Sacchetti | 315/159 |
| 5,457,442 | 10/1995 | Lucero | 340/541 |
| 5,483,224 | 1/1996 | Rankin et al. | 340/539 |
| 5,489,891 | 2/1996 | Diong et al. | 340/567 |
| 5,555,454 | 9/1996 | Dees | 340/541 |
| 5,661,370 | 8/1997 | Messick | 340/541 |

FOREIGN PATENT DOCUMENTS

| | | |
|---|---|---|
| 604160 | 4/1989 | Australia . |
| 2463565 | 3/1981 | France . |
| 2594245 | 8/1987 | France . |
| 3420188 | 1/1986 | Germany . |
| 3900605 | 7/1990 | Germany . |
| 97-296335/27 | 3/1997 | Netherlands . |
| 2205642 | 12/1988 | United Kingdom . |

OTHER PUBLICATIONS

Australian Industrial Property Organisation International–Type Search Report.

*Primary Examiner*—Jeffery A. Hofsass
*Assistant Examiner*—Van T. Trieu

[57] ABSTRACT

A portable security system 10 includes a control circuit 12 electrically connected with a motion sensor 14, an audible alarm 16 and a visual alarm 18. These components are held within a housing 20 which has a standard light globe/tube electrical connector 22 attached to one end 24 for allowing connection to mains power through a corresponding standard light globe/tube socket. A standard light globe 26 is demountably connected within the housing 20 to illuminate an area in the same manner as if the globe 26 were connected directly into the socket which receives the connector 22. A portable remote controller 28 switches the control circuit 12 between an ON state in which the control circuit is active to operate the audible and visual alarms 16, 18 upon detection of a moving body by the motion detector 14; and, an OFF state in which the control circuit deactivates the motion sensor 14 and allows the light globe 26 to be operated as a standard light globe by the switch for the socket to which the connector 22 is connected. Thus, the system 10 can be simply installed in an conventional light socket.

33 Claims, 1 Drawing Sheet

PORTABLE SECURITY SYSTEM

BACKGROUND OF THE INVENTION

Description of the Related Art

Many security systems are presently available for protecting residential and commercial premises. These systems usually comprise one or more sensors, an audible alarm, a visual alarm, and a controller, all interlinked. These components are usually placed in different physical locations and connected together by cables. Even when these components are interlinked by wireless links, the controller is generally hardwired into the mains power although, it will usually also have a battery backup.

These types of systems are very useful in deterring: unauthorised entry into a premises; theft; and, vandalism. However, because of the complexity of these systems, the need to have specialist technicians to install them, and their cost, they are not considered to be portable. Generally they will be installed in a premises and left there on a permanent basis.

At times however, it would be particularly beneficial if a security system were available which is fully and easily portable. This would be of great assistance to people going on holidays or people having jobs which require them to move frequently from place to place. It is this need which as lead to the development of the present invention.

SUMMARY OF THE INVENTION

According to the present invention there is provided a portable security system including:

- a control circuit in electrical connection with a motion sensing device and an alarm device, all mounted on or within a housing, the housing having a standard light globe/tube electrical connector for allowing connection to mains power through a corresponding standard light globe/tube socket;
- a standard light globe/tube demountably connected within or to the housing for illuminating an area; and,
- a portable remote controller for switching the control circuit between an ON state in which the control circuit is active to operate the alarm device upon the detection of a moving body by the motion sensing device, and an OFF state in which the control circuit deactivates the motion sensing device and allows the light globe/tube to be operated by a conventional switch for the socket in which the housing is connected.

Preferably the housing includes a first part which is provided with a second socket in which the standard light globe/tube is demountably connected, and a support member extending across the first part for supporting the second socket.

Preferably the standard light globe/tube connector is attached to the first part and the support member includes a heat shield extending across the first part and defining a heat shielded space between the heat shield and the connector in which the control circuit is disposed.

Preferably the alarm device includes an audible alarm disposed in the heat shielded space.

Preferably the first part includes at least one opening adjacent the heat shielded space for allowing transmission of sound generated by the audible alarm and to provide cooling to the interior of the housing.

Preferably the motion sensing device is held in or on a second part of the housing and disposed to provide 360° coverage, the second part supported by or demountably connected to the first part.

In one embodiment the second part is in the form of a cover which demountably connects with the first part. But in an alternate variation the second part may be in the form of an arm or stalk on which the motion sensing device is supported.

Preferably the alarm device further includes a visible alarm.

Preferably the visible alarm is housed between the heat shield and the second part.

Preferably the portable security system further includes a battery held within the heat shielded space for providing power to the control circuit, motion sensing device, and alarm device when mains power is not switched to the socket.

Preferably the control circuit is electrically connected to the socket and is operable to detect whether or not mains power is available and to facilitate powering of the motion sensing device and alarm device via: the mains power when the mains power is available; and, the battery when the mains power is not available.

Preferably the control circuit is operable to disable operation of the standard light globe/tube when it detects that mains power is not available.

Preferably the battery is a rechargeable battery and the portable security system includes a recharger disposed in said heat shielded space to recharge the battery when mains power is detected as being available.

Preferably the remote controller includes a transmission circuit for sending a control signal to the control circuit to switch the control circuit between the ON and OFF states.

Preferably the control circuit is operable to provide a predetermined delay before switching to the ON state upon receipt of the control signal from the remote controller.

An embodiment of the present invention will now be described by way of example only with reference to the accompanying drawings in which:

DETAILED DESCRIPTION OF THE PREFERRED EMBODIMENTS

Figure 2:
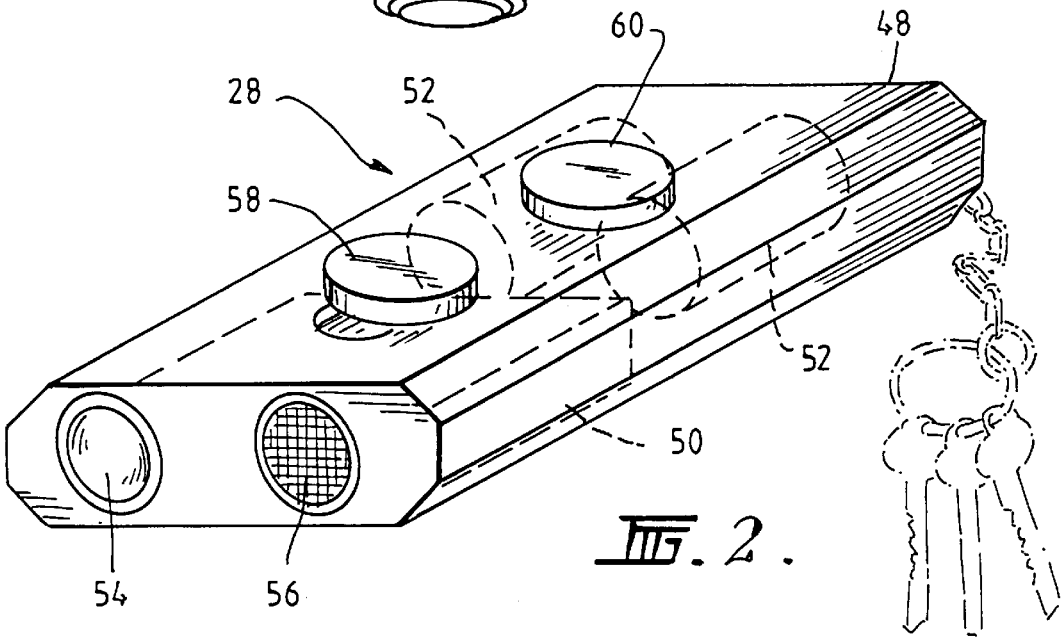
FIG. 2 is a schematic representation of the remote controller of the portable security system.

Referring to the accompanying drawings, the portable security system 10 includes a control circuit 12 electrically connected with a motion sensing device 14 and an alarm device comprising an audible alarm 16 and visual alarm 18. These components are held within a housing 20 which has a standard light globe/tube electrical connector 22 attached to one end 24 for allowing connection to mains power through a corresponding standard light globe/tube socket (not shown). A standard light globe 26 is demountably connected within the housing 20 to illuminate an area in essentially the same manner as if the globe 26 were connected directly into the socket which receives the connector 22. A portable remote controller 28 (shown in FIG. 2) switches the control circuit 12 between and ON state in which the control circuit 12 is active to operate the audible and visual alarms 16, 18 upon detection of a moving body by the motion sensing device 14, and an OFF state in which the control circuit deactivates the motion sensing device 14 and allows the light globe 26 to be operated as a standard light globe by a conventional switch (not shown) for the socket to which the connector 22 is connected.

The housing 20 is in the shape of an ellipsoid or egg and comprises first and second parts 20A and 20B which are demountably connected together. The first part 20A is provided with a socket 30 to which the light globe 26 is demountably connected. The socket 30 is support by support member 32 which extends across the interior of the first part 20A. The support member 32 is also formed as, or can have attached thereto, a heat shield which, together with the socket 30 defines a heat shielded space 34 between and undersurface of the heat shield and the connector 22. The control circuit 12, audible alarm 16 and other electrical components of the system 10 are disposed within the heat shielded space 34.

Also disposed within the heat shielded space 34 is a rechargeable battery 36 and a battery charger 38. The control circuit 12, audible alarm 16, and battery recharger 38 are either standard off-the-shelf devices or can be constructed using known technology and techniques. These components per se do not form part of the inventive concept. A number of slots 40 are cut into the first part 20A of the housing to allow for the transmission of sound from the audible alarm 16 and also to assist in the cooling of the components of the system held within the housing 20 and in particular, the heat shielded space 34.

The visual alarm 18 is in the form of a strobe light and is also demountably connected to a socket (not shown) supported by the support member 32. This allows easy replacement of the strobe light 18 when necessary.

The motion sensing device 14 may be in the form of a infra red detector or a microwave or ultrasound based detector and is mounted at an end of part 20B opposite the connector 22. The motion sensing device 14 is disposed so as to provide 360° coverage. A heat shield 42 is placed between the motion sensing device 14 and the light globe 26. A cable 44 provides electrical connection between the motion sensing device 14 and the control circuit 12. The end of cable 44 distant the device 14 is provided with a demountable connector 46 to facilitate complete separation of the housing parts 20A and 20B.

At least the second part 20B of the housing is formed of a transparent or translucent material to allow the transmission of light from both the globe 26 and the strobe 18. It is envisaged that the two parts 20A and 20B will be either press fitted or snap fitted together.

The remote controller 28 is formed as a small hand held key ring having an exterior housing 48. The housing 48 contains a transmission circuit 50 and batteries 52 for providing power to the remote controller 28. The remote controller 28 also includes a light source and light focusing lens 54 and an inbuilt audible alarm 56. Two separate control buttons 58 and 60 are provided to operate the system 10 and remote controller 28.

The transmitter circuit 50 is either a off-the-shelf component or can be constructed using known components and electronic circuit design techniques. The remote controller 28 is multifunctional in that it can operate: to control the system 10; as a personal stand alone alarm; and, as a small torch in addition as acting as a key ring.

The button 58 controls a multi position switch which operates as follows. When the button 58 is moved to a first switching position, the light 54 is operated so that the remote controller 28 operates as a torch. The light 54 remains operated as long as the button 58 is held in the first switching position. Once the button 58 is released, the light 54 is turned off. When the button 58 is moved to a second switching position it activates the audible alarm 56. The button 58 remains in the second position even without being physically held there. This ensures that the audible alarm 56 continues to operate even if the remote controller 28 falls from the operator's hand. Thus the remote controller can also act as a stand alone personal alarm. To deactivate the audible alarm 56, the button 58 must be depressed one more time.

The batteries 52 provide power for the light 54 and audible alarm 56 until a predetermined minimal power level is detected by the transmission circuit 50. When this minimum power level is reached, neither the light 54 nor the audible alarm 56 will operate. The minimum power level is sufficient to enable the remote controller 28 to operate to the extent that the transmission circuit 50 can transmit control signals to the control circuit 12 (through operation of the button 60 as will be described herein below). The deactivation of the light 54 and audible alarm 56 when the minimum power level is reached, also serves as an indicator to the operator that the batteries 52 require replacement.

The operation and functionality of the system 10 will now be described.

In order to install the system 10, a standard light globe at the premises at which the system 10 is to be installed is removed from its socket and replaced with housing 20 which is connected thereto by its connector 22. In the absence of activation of the control circuit 12, the system 10 will operate as a standard light with the light globe 26 operating to illuminate an area when the switch for the socket to which the connector 22 is connected is switched ON of OFF.

When the switch for the socket to which connector 22 is connected is turned ON, mains power is used to power all of the electrical components within the housing 20, including the battery recharger 38 to recharge the battery 36. When the switch is turned OFF, or during a power failure, all of the electrical components within the housing 20 are powered by the battery 36 with the exception of the light globe 26. If ever the light globe 26 blows, it can be simply replaced by pulling the second part 20B of the housing 20 away from the first part 20A and replacing globe 26 in a conventional manner.

To activate the system 10, the button 60 on the remote controller 28 is pushed once. This causes the transmitter 50 to transmit a control signal which is received by the control circuit 12. The control circuit 12 in turn briefly operates the audible alarm 16 to provide audible feed back of that the control signal has been received and, after a predetermined delay to allow exit of the room or area under the surveillance of the system 10, the control circuit 12 will turn OFF the globe 26 (if it was previously ON). The system 10 is now active with the motion detecting device 14 operational to detect the motion of a body. If motion is detected, the control circuit 12 switches ON the light globe 26 and the strobe 18 (provided mains power is available to the system 10) and, after a further short delay, say five seconds operates the audible alarm 16. The short delay is provided for to allow deactivation via the remote controller 28 upon entry by an authorised person to the area under surveillance of the system 10. If mains power is turned OFF, the strobe 18 will still be turned ON but the globe 26 will not operate upon the detection of the motion of a body. Nevertheless, the short delay will still be provided prior to activation of the audible 16. The alarms will remain on for a predetermined period, say five minutes, at which time the system 10 will automatically reset to detect the next motion. If motion is again detected, the control circuit 12 will again operate the audible and/or visual alarms 16, 18 in the same manner as described above in relation to the first detection of motion.

To deactivate the control circuit 12 the button 60 must be pressed twice within a space of a short predetermined period such as five seconds. Deactivation is signalled by a predetermined audible signal such as three short beeps, accompanied by the turning ON of light globe 26 in the event that mains power is available.

To test the operation of this system 10, the button 60 is pressed and held down. After a predetermined time, such as five seconds, the system 10 will be active and capable of sensing any motion. Once motion is detected by the motion detector 14, the audible alarm 16 and visual alarm 18 will be activated and will remain active for as long as the button 60 is held down. Once the button 60 is released, the alarms 16, 18 will be turned OFF and the system 10 will revert to the OFF state.

For added security, the audible and visual alarm 16, 18 can be operated when the remote controller 28 is in the sensing range of the control circuit 12 by moving the button 58 to the second position (when button 58 is a push button this equates to pushing the button 58 twice). As previously described this operates the audible alarm 56 of the remote control. However importantly it also immediately activates the alarms 16 and 18 irrespective of whether or not the control circuit 12 is in the active state. The alarms 16, 18 will remain ON until the button 58 is again pressed. At this time, the circuit 12 will revert to the OFF state. This option is used to provide emergency operation of the alarms 16, 18 when an occupant of the dwelling to which this system 10 is fitted is present but the control circuit 12 has not been activated.

Now that an embodiment of the present invention has been described in detail it would be apparent to those skilled in the relevant arts and numerous modifications and variations may be made without departing from the basic inventive concepts. For example, the connector 22 can be in the form of any standard connector for a light fitting such as a baynet connector as shown or a screw connector. Also, the various delay periods mentioned in the above description can be varied. Any type of standard off-the-shelf motion detector 14 can be used in the system 10. Additionally if required more than one motion sensor 14 can be used in the system 10.

As an optional feature, the system 10 can also include a transmitter for transmitting a signal upon the detection of a motion of the body (when the system 10 is not in a test state) and, an additional remote receiving device for receiving this signal and then activating further security devices such as additional sirens and possibly for making automatic connections to the Police or private security providers.

Figure 1:
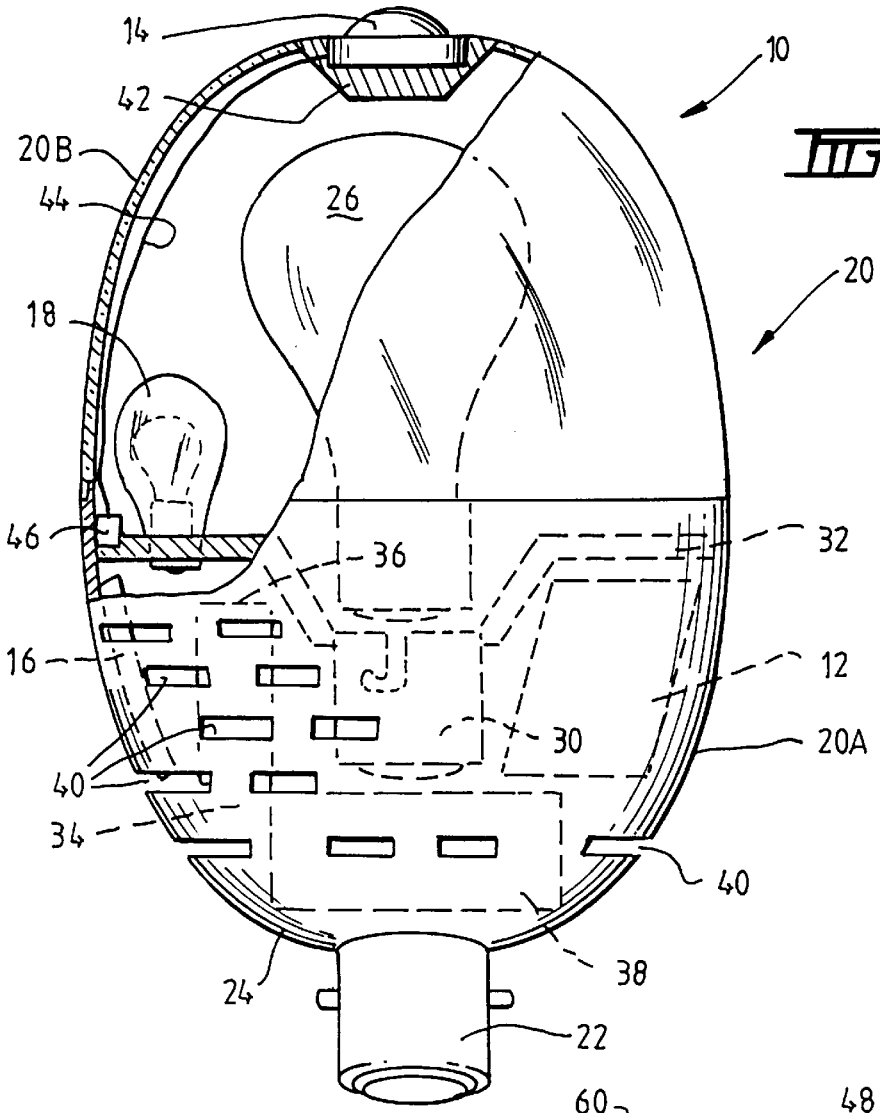
FIG. 1 is a schematic representation of the housing and internal components thereof of the portable security system.

In another variation the second part 20B could be replaced with an arm of stalk which is connected to the first part 20A and on which the motion sensing device 14 is supported in much the same position as shown in FIG. 1. In this variation the cable 44 would be housed within the arm or stalk, and if desired the heat shield 42 may also be supported by the arm or stalk beneath the sensing device 14.

All such modifications and variations together with those which would be apparent to people of ordinary skill in the art are deemed to be within the scope of the present invention the nature of which is to be determined from the aforegoing description and the appended claims.

I claim:

1. A portable security system including:

a control circuit in electrical connection with a motion sensing device and an alarm device, all mounted within a housing, the housing having a standard light globe/tube electrical connector for allowing connection to mains power through a corresponding standard light globe/tube socket;

a standard light globe/tube demountably connected within or to the housing for illuminating an area; and, a portable remote controller for switching the control circuit between an ON state in which the control circuit is active to operate the alarm device upon the detection of a moving body by the motion sensing device, and an OFF state in which the control circuit deactivates the motion sensing device and allows the light globe/tube to be operated by a conventional switch for the socket in which the housing is connected.

2. A portable security device according to claim 1 wherein, the housing includes a first part which is provided with a second socket in which the standard light globe/tube is demountably connected, and a support member extending across the first part for supporting the second socket.

3. A portable security device according to claim 2 wherein, the standard light globe/tube connector is attached to the first part and the support member includes a heat shield extending across the first part and defining a heat shielded space between the heat shield and the connector in which the control circuit is disposed.

4. A portable security device according to claim 3 wherein, the alarm device includes an audible alarm disposed in the heat shielded space.

5. A portable security device according to claim 4 wherein, the first part includes at least one opening adjacent the heat shielded space for allowing transmission of sound generated by the audible alarm and to provide cooling to an interior of the housing.

6. A portable security device according to claim 2 wherein, the motion sensing device is held in or on a second part of the housing and disposed to provide 360° coverage, the second part supported on or demountably connected to the first part.

7. A portable security device according to claim 4 wherein, the alarm device further includes a visible alarm.

8. A portable security device according to claim 7 wherein, the visible alarm is housed between the heat shield and the second part.

9. A portable security device according to claim 3 further including, a battery held within the heat shielded space for providing power to the control circuit, motion sensing device, and alarm device when mains power is not switched to the socket.

10. A portable security device according to claim 9 wherein, the control circuit is electrically connected to the socket and is operable to detect whether or not mains power is available and to facilitate powering of the motion sensing device and alarm device via: the mains power when the mains power is available; and, the battery when the mains power is not available.

11. A portable security device according to claim 1 wherein, the control circuit is operable to disable operation of the standard light globe/tube when it detects that mains power is not available.

12. A portable security device according to claim 9 wherein, the battery is a rechargeable battery and the portable security system includes a recharger disposed in said heat shielded space to recharge the battery when mains power is detected as being available.

13. A portable security device according to claim 1 wherein, the remote controller includes a transmission circuit for sending a control signal to the control circuit to switch the control circuit between the ON and OFF states.

14. A portable security device according to claim 13, wherein the remote controller includes a power supply and an inbuilt audible alarm operable on activation of a button or switch, the remote controller being configured to disable operation of the inbuilt audible alarm if a predetermined minimum power level of the power supply is reached, the predetermined minimum power level being sufficient to power the transmission circuit to send the control signal to the control circuit.

15. A portable security device according to claim 14, wherein the remote controller further includes an inbuilt light operable on activation of said button or switch and wherein the inbuilt light is disabled when the predetermined minimum power level is reached.

16. A portable security device according to claim 14, wherein said button or switch is operable to simultaneously cause operation of the inbuilt alarm and to operate the transmission circuit to send the control signal in the event that the power level of the power supply is above the predetermined minimum power level and the remote controller is in the sensing range of the control circuit.

17. A portable security device according to claim 1 wherein, the control circuit is operable to provide a predetermined delay before switching to the ON state upon receipt of the control signal from the remote controller.

18. A portable security system including:

a control circuit in electrical connection with a motion sensing device and an alarm device, all mounted within a housing, the housing having a standard light globe/tube electrical connector for allowing connection to mains power through a corresponding standard light globe/tube socket;

a standard light globe/tube for illuminating an area, the housing including a first part which is provided with a second socket in which the standard light globe/tube is demountably connected, and a support member extending across the first part for supporting the second socket; and a portable remote controller for switching the control circuit between an ON state in which the control circuit is active to operate the alarm device upon the detection of a moving body by the motion sensing device, and an OFF state in which the control circuit deactivates the motion sensing device and allows the light globe/tube to be operated by a conventional switch for the socket in which the housing is connected.

19. A portable security device according to claim 18, wherein the standard light globe/tube connector is attached to the first part and the support member includes a heat shield extending across the first part and defining a heat shielded space between the heat shield and the connector in which the control circuit is disposed.

20. A portable security device according to claim 19, wherein the alarm device includes an audible alarm disposed in the heat shielded space.

21. A portable security device according to claim 20, wherein the first part includes at least one opening adjacent the heat shielded space for allowing transmission of sound generated by the audible alarm and to provide cooling to an interior of the housing.

22. A portable security device according to claim 18, wherein the motion sensing device is held in or on a second part of the housing and disposed to provide 360° coverage, the second part supported on or demountably connected to the first part.

23. A portable security device according to claim 20, wherein the alarm device further includes a visible alarm.

24. A portable security device according to claim 23, wherein the visible alarm is housed between the heat shield and the second part.

25. A portable security device according to claim 19, further including a battery held within the heat shielded space for providing power to the control circuit, the motion sensing device, and the alarm device when mains power is not switched to the socket.

26. A portable security device according to claim 25, wherein the control circuit is electrically connected to the socket and is operable to detect whether or not mains power is available and to facilitate powering of the motion sensing device and alarm device via: the mains power, when the mains power is available; and the battery, when the mains power is not available.

27. A portable security device according to claim 18, wherein the control circuit is operable to disable operation of the standard light globe/tube when the control circuit detects that mains power is not available.

28. A portable security device according to claim 25, wherein the battery is a rechargeable battery and the portable security system includes a recharger disposed in said heat shielded space to recharge the battery when mains power is detected as being available.

29. A portable security device according to claim 18, wherein the remote controller includes a transmission circuit for sending a control signal to the control circuit to switch the control circuit between the ON and OFF states.

30. A portable security device according to claim 29, wherein the remote controller includes a power supply and an inbuilt audible alarm operable on activation of a button or switch, the remote controller being configured to disable operation of the inbuilt audible alarm if a predetermined minimum power level of the power supply is reached, the predetermined minimum power level being sufficient to power the transmission circuit to send the control signal to the control circuit.

31. A portable security device according to claim 30, wherein the remote controller further includes an inbuilt light operable on activation of said button or switch and wherein the inbuilt light is disabled when the predetermined minimum power level is reached.

32. A portable security device according to claim 30, wherein said button or switch is operable to simultaneously cause operation of the inbuilt alarm and to operate the transmission circuit to send the control signal in the event that the power level of the power supply is above the predetermined minimum power level and the remote controller is in the sensing range of the control circuit.

33. A portable security device according to claim 18, wherein the control circuit is operable to provide a predetermined delay before switching to the ON state upon receipt of the control signal from the remote controller.

* * * * *